US005366437A

United States Patent [19]

Graston

[11] Patent Number: 5,366,437

[45] Date of Patent: Nov. 22, 1994

[54] TOOLS FOR PERFORMING SOFT TISSUE MASSAGE

[76] Inventor: David A. Graston, 9133 Lansburgh Ct., Indianapolis, Ind. 46234

[21] Appl. No.: 83,029

[22] Filed: Jun. 25, 1993

Related U.S. Application Data

[63] Continuation of Ser. No. 758,871, Sep. 11, 1991, Pat. No. 5,231,977.

[51] Int. Cl.[5] ..... A61H 7/00

[52] U.S. Cl. ..... 601/135; 601/134; 601/1

[58] Field of Search ..... 128/67, 29 R, 25 R, 128/24.2, 26; 606/1, 53, 106; 601/1, 23, 40, 134, 135, 136, 137

[56] References Cited

U.S. PATENT DOCUMENTS

| | | | |
|---|---|---|---|
| 26,798 | 12/1859 | Norton . | |
| 30,230 | 2/1861 | Barnet . | |
| D. 113,159 | 1/1939 | Defilippis . | |
| 237,681 | 2/1881 | Fuller . | |
| 663,303 | 12/1900 | Sutton . | |
| 717,456 | 12/1902 | Schiele . | |
| 1,380,247 | 5/1921 | Price . | |
| 2,044,112 | 6/1936 | Widmann . | |
| 2,694,396 | 11/1954 | Paschal . | |
| 2,777,440 | 1/1957 | Baker . | |
| 3,080,593 | 3/1963 | Wilson . | |
| 3,389,418 | 6/1968 | Sencabaugh . | |
| 4,483,328 | 11/1984 | Wolocko . | |
| 4,590,926 | 5/1986 | Courtin . | |
| 4,648,387 | 3/1987 | Simmons . | |
| 4,705,030 | 11/1987 | Tepperberg . | |
| 4,776,835 | 10/1988 | Lee | 604/1 |
| 4,936,293 | 6/1990 | Rymaruk | 128/54 |
| 5,066,494 | 11/1991 | Becher . | |

FOREIGN PATENT DOCUMENTS

| | | |
|---|---|---|
| 1200089 | 12/1959 | France . |
| 2523438A | 3/1982 | France . |
| 848544 | 7/1949 | Germany . |
| 909768 | 4/1954 | Germany . |

OTHER PUBLICATIONS

Horrigan, Joseph, "Soft Tissue Center–Therapy Facility of Tomorrow", *Ironman,* Jun. 1990, pp. 115–119.

Advertising brochure entitled "Therapy Plus–The Pain Reliever", date unknown, but believed to be before 1992.

*Primary Examiner*—Sam Rimell

*Attorney, Agent, or Firm*—Baker & Daniels

[57] ABSTRACT

A set of tools for use by a trainer in performing soft tissue massage, wherein each tool includes a handle portion and a skin engagement portion that is configured to generally match the contour of the impaired area of soft tissue to be treated. The skin engagement portion includes an edge surface that noninvasively engages the skin to allow the user to locate fibrous adhesions that are attached to the underlying soft tissue areas. A first tool is selected having a bevelled edge for breaking up the scar tissue, whereafter a second tool may then be selected having a blade edge for pulling the broken up scar tissue away from the affected soft tissue area. The soft tissue area is then stretched as much as possible and the treatment repeated until all of the scar tissue has been removed from the soft tissue area.

6 Claims, 6 Drawing Sheets

TOOLS FOR PERFORMING SOFT TISSUE MASSAGE

This is a continuation division of application Ser. No. 07/758,871, filed Sep. 11, 1991, now U.S. Pat. No. 5,231,997.

BACKGROUND OF THE INVENTION

The present invention relates generally to massage implements and, more particularly, to a tool used by a trainer for the therapeutic massaging of soft tissue areas of the human body.

Inflammation of soft tissue areas of the human body may occur as the result of a major trauma, such as surgery, or a repeated micro-trauma, such as overtraining. The body responds by forming fibrous adhesions, or scar tissue, which is an unavoidable by-product of the healing process. The scar tissue forms in soft tissue areas of the human body, such as muscles, tendons, and ligaments. As scar tissue builds up, it prevents the muscles, tendons, and ligaments from lengthening and contracting, thereby resulting in lost range of motion, pain, and decreased stability. In addition, the build-up of scar tissue generally causes pain in the affected joint and surrounding areas. This pain often causes the sufferer to believe that an injury still exists; however, in most cases, the injury itself has healed. Therefore, it is desirable to remove the scar tissue so that the joint may achieve a greater level of performance.

Scar tissue is removed by a process known as soft tissue therapy, which involves use of the trainer's hand to manually massage the skin over the affected soft tissue areas to release scar tissue adhesions and regain lost resting length in the tissue. This type of massage includes cross-frictional massage, deep muscle massage, and rolfing.

One problem associated with manual massage of soft tissue areas is the difficulty in applying the appropriate amount of manual pressure. In some instances, too much pressure may be exerted by the trainer on some soft tissue areas, thereby causing unnecessary discomfort to the patient. In other instances in which hardened scar tissue has built up on tendons and ligaments near bone surfaces, the trainer may not be able to apply sufficient pressure with his or her hands to provide an effective treatment. In addition, it is frequently difficult for the trainer to manually locate scar tissue with sufficient specificity using his or her hand. Furthermore, it has been found that performing manual massage for an extended period of time may result in hand injuries to the trainer such as tendonitis.

SUMMARY OF THE INVENTION

The present invention overcomes the aforementioned problems and disadvantages by providing a set of tools that are uniquely configured to generally match the contour of impaired areas of soft tissue to be treated, whereby skin over the affected area is massaged with the tools sufficiently to locate, loosen, break up, and remove fibrous scar adhesions from the impaired soft tissue area.

In general, the invention provides a rigid tool having a handle portion and a skin engagement portion that is configured to generally match the contour of the impaired soft tissue area to be treated. More specifically, the skin engagement portion includes an edge surface that engages the skin to noninvasively allow the user to locate fibrous adhesions that are attached to the underlying soft tissue areas. Thereafter, greater pressure may be applied with the edge surface to loosen the fibrous adhesions from the surrounding soft tissue areas. Then, the edge surface may be manipulated along the skin to break up the loosened fibrous adhesions and pull them away from the impaired soft tissue area.

An advantage of the massaging tool of the present invention is that the trainer can locate fibrous adhesions on soft tissue surfaces that may not otherwise be located by hand therapy.

Another advantage of the massaging tool of the present invention is that more pressure may be applied with greater specificity to the fibrous adhesions to more quickly and efficiently break up and remove the adhesions from the soft tissue.

A further advantage of the massaging tool of the present invention is that the tool allows the trainer to direct the applied pressure to the affected soft tissue areas and to minimize the pressure applied to unaffected soft tissue areas surrounding the fibrous adhesions, thereby minimizing discomfort to the patient.

Another advantage of the massaging tool of the present invention is that the tool is configured to generally match the shape of the affected joint or soft tissue area so that more of the affected area may be massaged than by using one's hands, especially areas that may be difficult to reach and/or massage with one's hands.

Yet another advantage of the massaging tool of the present invention is that the likelihood of hand injury such as tendonitis, to the trainer is minimized.

A still further advantage of the present invention is that a set of tools may be utilized to massage any selected soft tissue area of the body, whereby each tool of the set is configured to match the contour of a selected soft tissue area.

The present invention, in one form thereof, provides a set of tools for use by a trainer to apply pressure to the skin of a patient for removal of fibrous scar tissue adhesions from underlying soft tissue. Each tool of the set includes a handle portion and a skin-contacting portion that is shaped to correspond generally to the contour of a selected part of the patient's body from which a scar tissue adhesion is to be removed. The skin-contacting portion of the selected tool includes a peripheral edge for making noninvasive contact with the scar tissue adhesion.

The invention further provides, in one form thereof, a method of removing fibrous scar tissue adhesions from underlying soft tissue. The method includes selecting a first tool of the set of tools and passing the first skin-contacting portion of the first tool across the skin to permit noninvasive contact of the first peripheral edge with the adhesion sufficiently to loosen and break up the fibrous adhesions from the soft tissue. A second tool of the set is then selected which includes a second skin-contacting portion having a second peripheral edge that is shaped differently from the first peripheral edge. The second skin-contacting portion is passed across the skin to permit noninvasive contact of the second peripheral edge with the adhesion sufficiently to pull the broken-up fibrous adhesions away from the soft tissue.

DESCRIPTION OF THE PREFERRED EMBODIMENT

Figure 1:
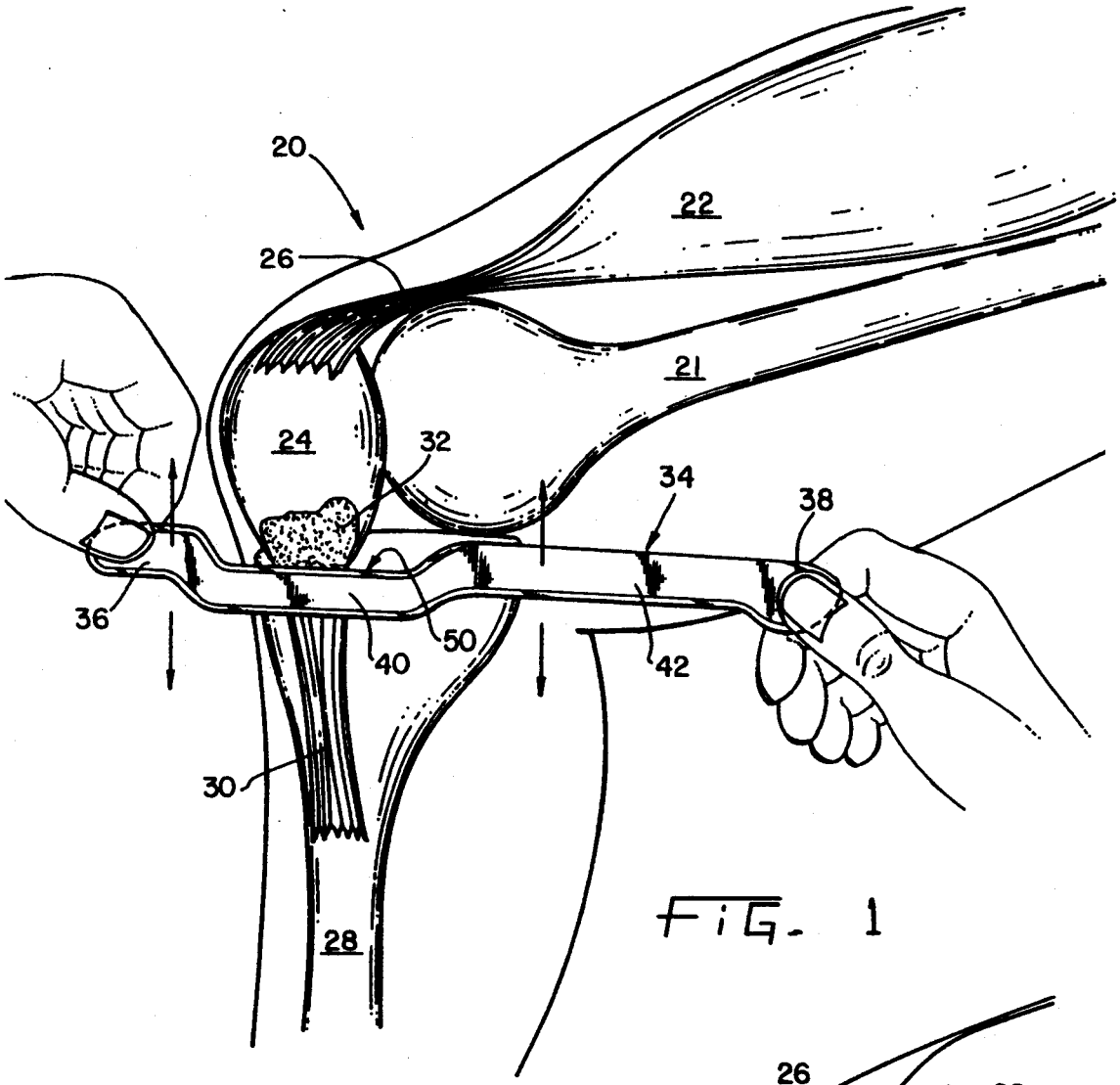
FIG. 1 is a perspective view with a human knee joint in cross-section, showing a tool according to the present invention engaging scar tissue that has built up on the ligament below the patella.
Figure 2:
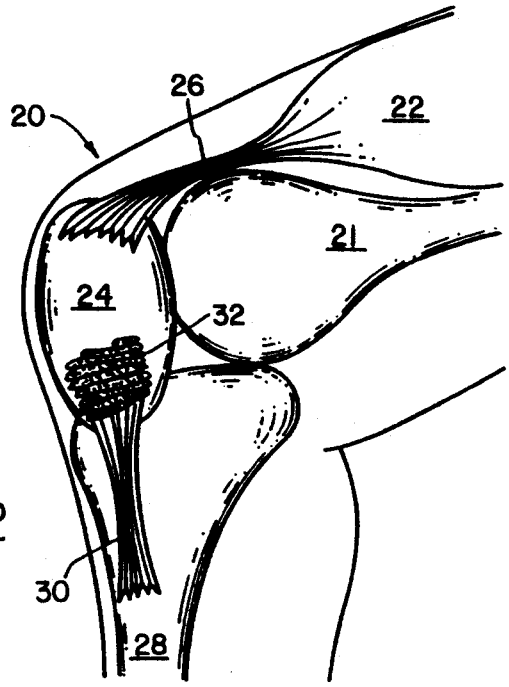
FIG. 2 is a view of the knee joint of FIG. 1, particularly showing layers of fibrous scar tissue adhesions and their attachment to the ligament.
Figure 3:
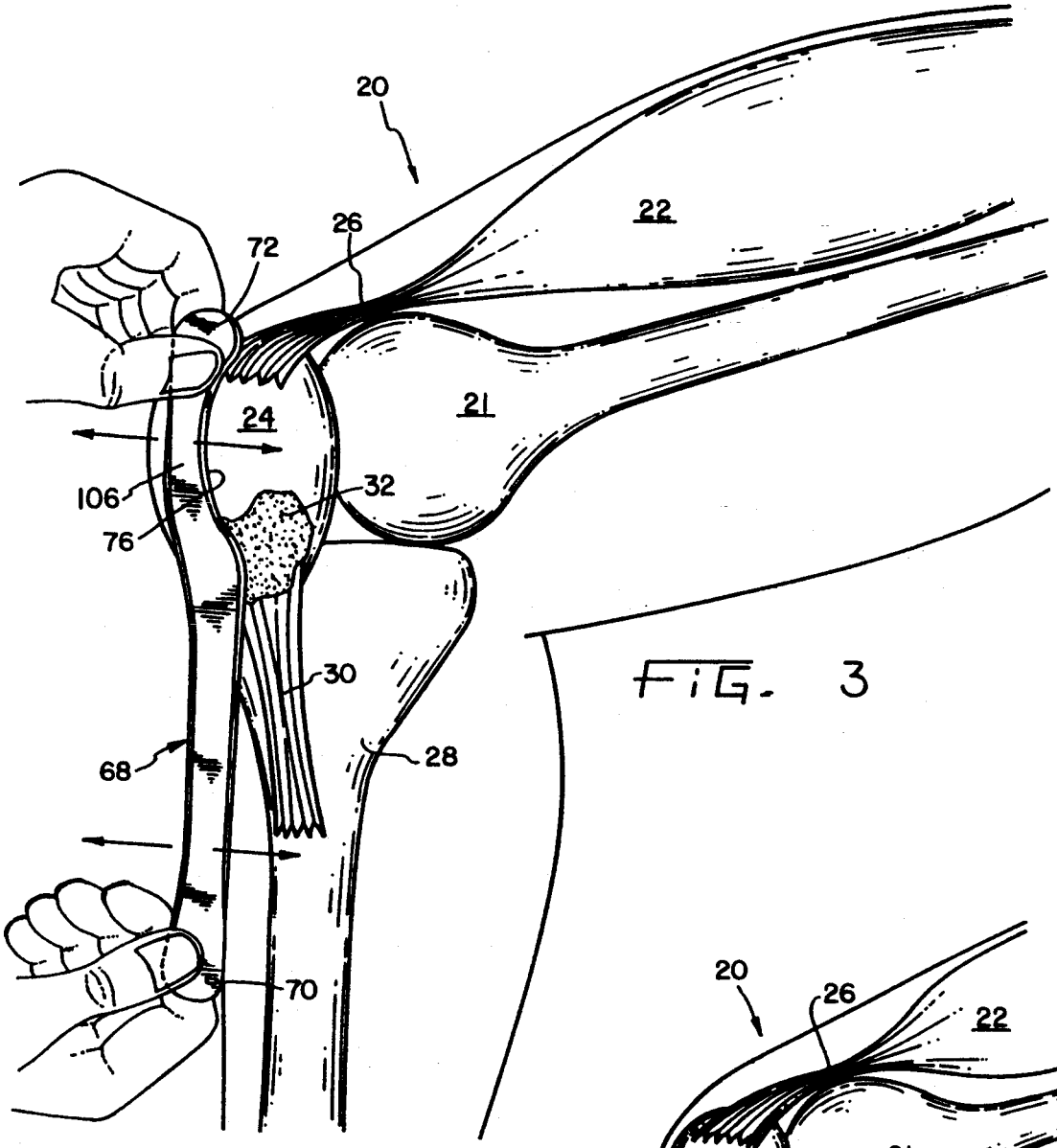
FIG. 3 is a view similar to that shown in FIG. 1, except that a different tool is being used to engage the scar tissue.
Figure 4:
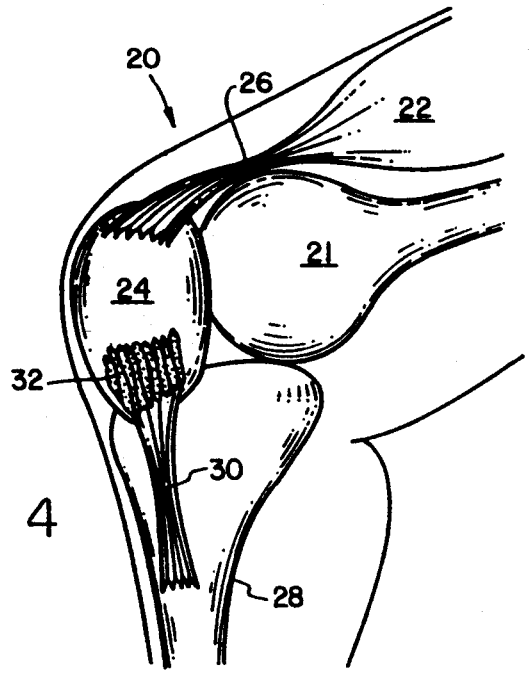
FIG. 4 is a side view of FIG. 3 again showing the layers of scar tissue built up on the ligament.

Referring now to the drawings, and in particular to FIG. 1, there is shown a human leg 20 having a femur 21 and a quadriceps muscle 22 that is attached to patella 24 by tendon 26. Similarly, there is shown a tibia 28 that is connected to patella 24 by a patellar ligament 30, which is subject to a great amount of stress and injury. It should be noted that in FIG. 1, as well as FIGS. 2–6, other soft tissue areas in the area of the knee joint have been omitted for the sake of clarity in the following description. Once injured, scar tissue or fibrous adhesions 32 are formed on ligament 30 as a result of the healing process. As best shown in FIGS. 2 and 4, scar tissue 32 is made up of individual fibers bound together. As scar tissue 32 comes into contact with bone, in this case 30 patella 24, it becomes hard and takes away flexibility in the lower knee joint. The scar tissue shown in FIGS. 1–6 is generally in a first phase. In more severe cases, scar tissue has advanced around the joint capsule and has formed on other adjacent soft tissue areas. It should be noted that the present invention is designed to remove scar tissue in varying degrees of advancement.

Figure 10B:
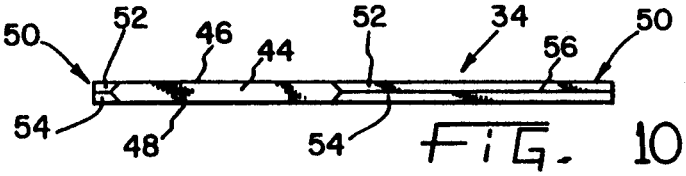
Figure 10A:
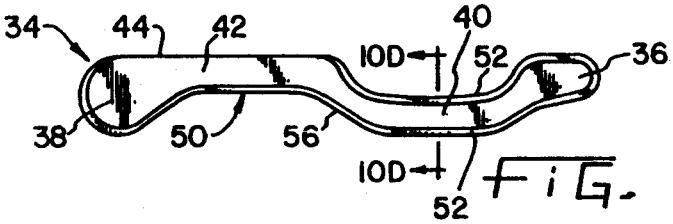
Figure 10D:
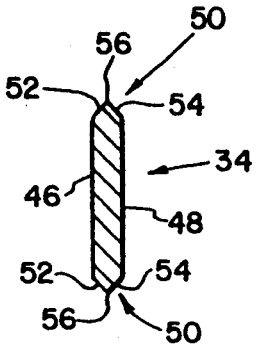
Figure 10C:
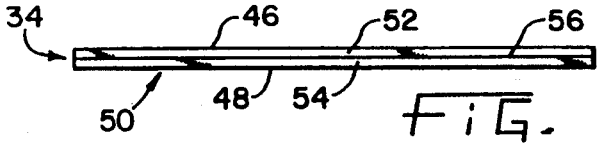
Figure 11B:
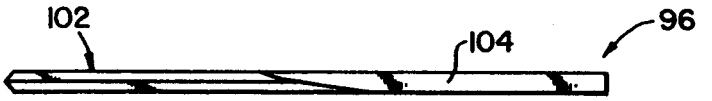
Figure 11A:
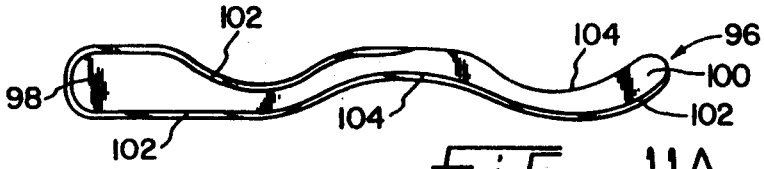
Figure 11C:
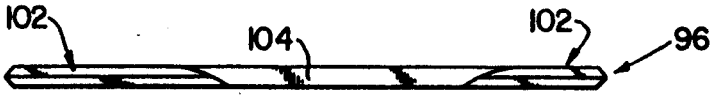
Figure 11D:
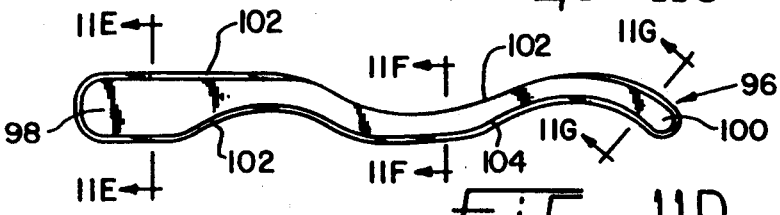
Figure 11E:
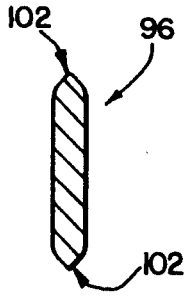
Figure 11F:
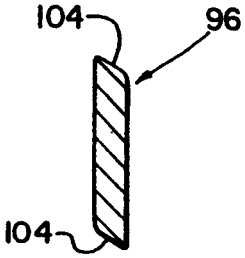
Figure 11G:
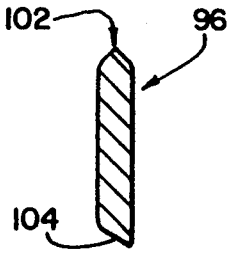

In accordance with one embodiment of the present invention, there is shown in FIG. 1 a rigid tool 34 for removing scar tissue 32 from patella 24 and ligament 30. Tool 34, which is preferably made of aluminum, generally comprises a handle portion and a skin-contacting portion. More specifically, tool 34 includes opposite ends 36 and 38, which serve as handles. The handle portions are generally rounded to fit comfortably in the hands of the trainer. The skin-contacting portion includes "contoured" portions 40 and 42. Essentially, these portions of tool 34 are contoured to match the shape of the joint being massaged thereby permitting greater coverage of the area to be massaged. Referring to FIGS. 10A–10D, tool 34 includes an outer peripheral edge that varies along the circumference of the tool. One portion of the peripheral edge is a flat edge 44 which is generally a flat surface that is perpendicular to the top 46 and bottom 48 surfaces of tool 34 (FIG. 10B). A second portion of the peripheral edge is a so-called "bevelled" edge 50 and includes upper bevelled surface 52 and lower bevelled surface 54. Surfaces 52 and 54 may be bevelled at various angles with respect to top 46 and bottom 48 surfaces, respectively. As shown in FIG. 10D, surfaces 52 and 54 are bevelled at about 135 degrees with respect to top 46 and bottom 48 surfaces, respectively. Surfaces 52 and 54 meet at edge 56.

Figure 7C:
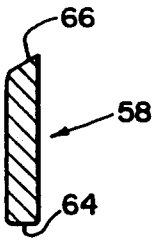
FIGS. 7A–7C, 8A–8D, 9A–9D, 10A–10D, and 11A–11G, show a variety of tools according to the present invention that may be utilized for the removal of scar tissue on different soft tissue areas of the body.
Figure 7B:
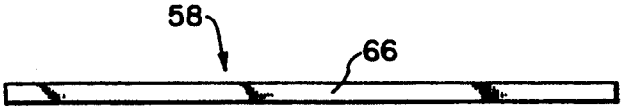
Figure 7A:
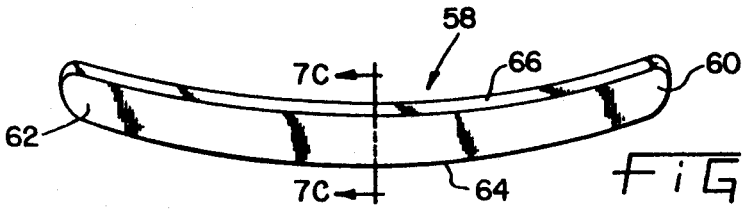
Figure 8B:
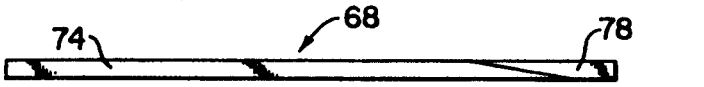
Figure 8A:
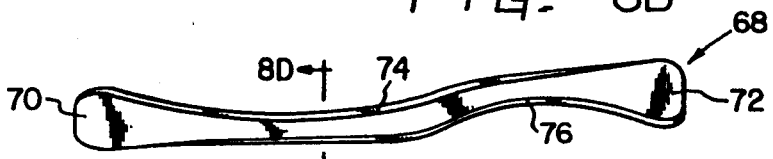
Figure 8D:
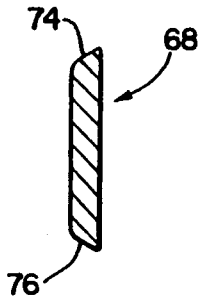
Figure 8C:
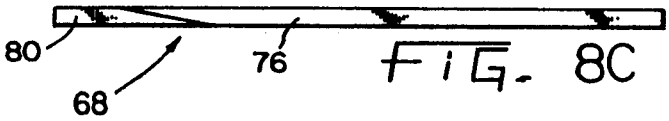
Figure 9B:
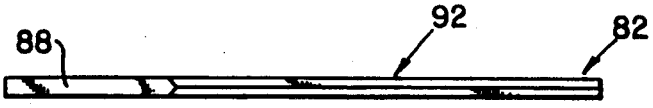
Figure 9A:
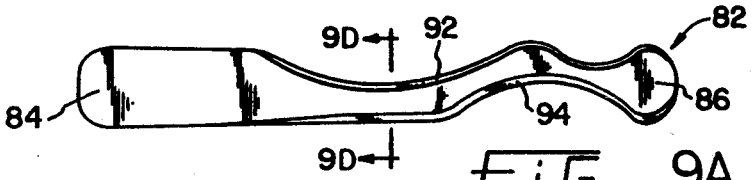
Figure 9D:
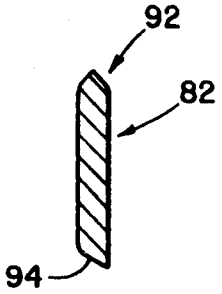
Figure 9C:
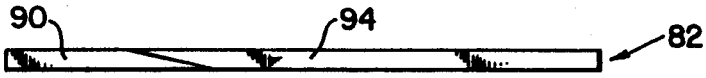

As shown in FIGS. 7A–11G, tool 34 is just one of a set of tools according to the present invention for use in soft tissue therapy. It is noted that the tools illustrated herein do not comprise an exhaustive list of tools that may be required for treatment of all soft tissue areas used, but are merely illustrative of the different shapes and sizes of tools available as a set to treat some parts of the body. In addition it is noted that each of the tools shown herein may be used on different parts of the body as needed. In FIGS. 7A–7C a tool 58 is shown including end portions 60 and 62 and having a flat edge 64 and a so-called "blade" edge that is tapered as best shown in FIG. 7C. It is noted that blade edge 66 of tool 58, as well as the blade edges of the remaining tools, are preferably rounded to a 50° radius or greater. Tool 58 is especially useful on larger soft tissue areas such as a back muscle or a hamstring. In FIGS. 8A–8D there is shown a tool 68 including handle portions 70 and 72 and having blade edges 74 and 76 as well as flat edges 78 and 80 at handles 72 and 70, respectively. FIGS. 9A–9D illustrate yet another tool 82 including handle portions 84 and 86. Handle portion 84 includes flat edges 88 and 90. The contoured portions of tool 82 include both a bevelled edge 92 and a blade edge 94. Finally, referring to FIGS. 11A–11G, there is shown a tool 96 having handle portions 98 and 100. The contoured portions of tool 96 include a bevelled edge 102 and a blade edge 104.

In order to perform soft tissue massage utilizing the tools according to the present invention, the affected soft tissue area is first topically treated with a lubricant such as a liniment or cocoa butter. The term "soft tissue" generally refers to a muscle, ligament, or tendon, or any combination thereof. It is noted that the tools of the present invention may be used on any part of the body in which a soft tissue injury has occurred and scar tissue has been built up as a result of the healing process. The particular soft tissue area illustrated herein, a knee joint, is merely illustrative of one possible application of the tools of the present invention.

Once the affected soft tissue area has been properly lubricated, a tool such as tool 34 is selected which has a contoured portion 40 that matches the contour of the affected joint. Tool 34 is then passed across the knee joint in the direction of the arrows as shown in FIG. 1 so that the precise location of scar tissue 32 is determined. Generally, "bumps" may be felt through the tool to indicate the presence of scar tissue at a particular location on the soft tissue. Such scar tissue is often undetectable by merely using one's hands alone. It is noted that the bevelled edge is very useful for locating hardened scar tissue or tissue close to bone, whereas the blade edge is useful for locating scar tissue that is not in such a hardened state.

Once the location of the scar tissue is determined, the scar tissue must be broken up. This is accomplished by movement of tool 34 in the manner shown in FIG. 1 so that bevelled edge 50 breaks up hardened scar tissue 32. Once tissue 32 begins to break up, an irritation occurs which causes swelling of the scar tissue. Next, tool 68 is selected and includes a contoured portion 106 that matches the contour of the knee joint as shown in FIG. 3. In particular, blade edge 76 of contoured portion 106 is manipulated under scar tissue 32 in the direction of the arrows of FIG. 3 so that scar tissue 32 is pulled in a cross fiber fashion. In this way, scar tissue 32 is pulled away from the individual fibers of ligament 30.

Figure 12:
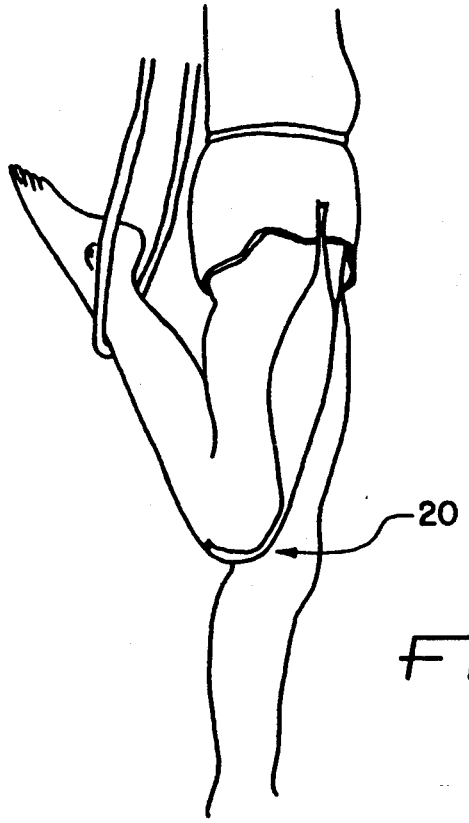
FIG. 12 is a perspective view particularly illustrating the soft tissue of the knee joint in a fully extended position.
Figure 13:
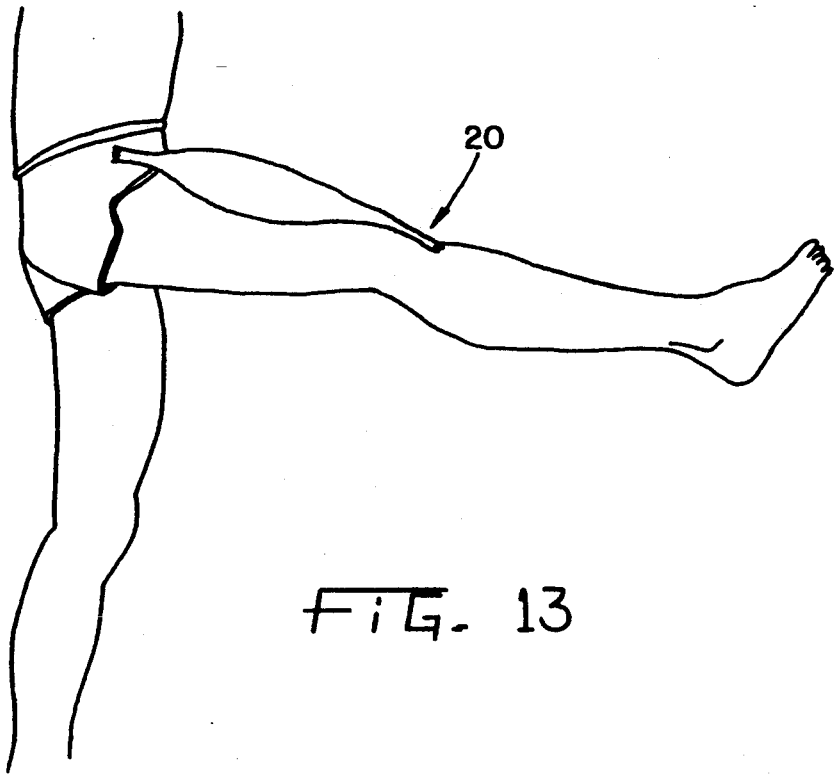
FIG. 13 is a perspective view similar to FIG. 12, except that the soft tissue of the knee joint is shown in its fully shortened position.

Once the scar tissue has been loosened from the affected soft tissue area, it is necessary to increase the range of motion of the joint. As shown in FIGS. 12 and 13, this is accomplished by working the soft tissue areas of the patella through a full range of motion. As shown in FIG. 12, the knee joint is fully flexed and should remain flexed for at least ten seconds. This allows the muscles, tendons, and ligaments to lengthen since the scar tissue has less of a hold on the joint. The soft tissue areas are then shortened as shown in FIG. 13 to complete movement of the joint throughout its full range of motion.

Figure 5:
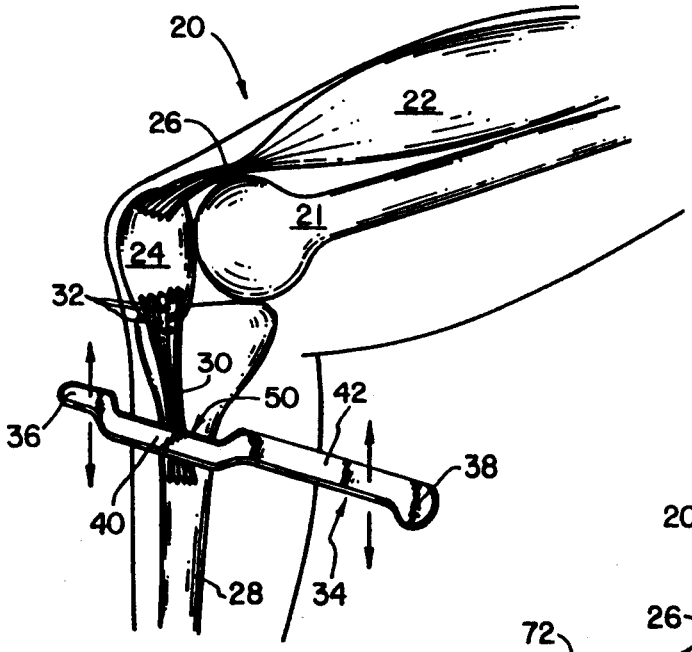
FIG. 5 is a view similar to that shown in FIG. 3, except that the scar tissue is shown being broken up as a result of repeated engagement with the tool shown in FIG. 1.
Figure 6:
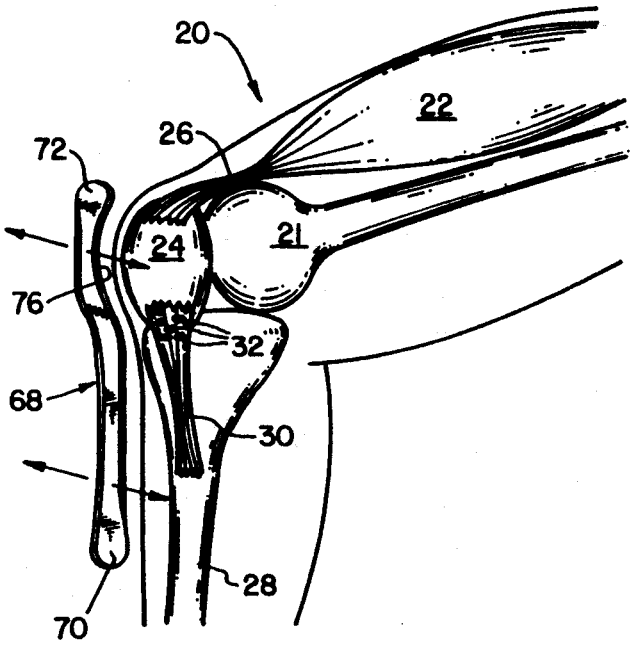
FIG. 6 is a view similar to that shown in FIG. 3, except that the scar tissue is shown being broken up as a result of repeated engagement with the tool shown in FIG. 3.

After the joint has been moved as shown in FIGS. 12 and 13, the soft tissue massage should be performed again in the same manner as described above. This additional massage helps to further break up scar tissue as shown in FIGS. 5 and 6. Once the massage has been performed for a second time, there is less scar tissue than when the joint was stretched the first time. At this point the patient must try to achieve a greater range of motion than previously. Again, the joint is stretched as shown in FIGS. 12 and 13. This stretching exercise should be conducted so that the joint is held in each of the illustrated positions for a longer period of time than for the previous stretching exercise. The entire procedure is then again repeated until the scar tissue has been alleviated and full flexibility has been regained. This often requires many daily sessions of therapy. At the end of each session, the affected soft tissue area should be applied with ice to reduce swelling and bruising and speed recovery.

As discussed previously, each of the above tools includes either a bevelled edge or a blade edge for making contacting engagement with the scar tissue. The bevelled edge provides for massaging at a less intense pressure making this edge useful for the initial breaking up of the scar tissue. In addition, the bevelled edge may be rocked back and forth across bone to help break up hardened scar tissue located near bone. The blade edge provides for massaging at a much more intense pressure, which is useful for separating the soft tissue areas from one another to break up scar tissue. In addition, the blade edge is useful for pulling the irritated and broken up scar tissue away from the affected soft tissue areas. It is appreciated that other types edges are possible in addition to the blade and bevelled edges described herein.

It has been previously noted that the contoured portion of each tool of the set is specially configured for a particular joint or soft tissue area that is subject to the build up of scar tissue. These tools may be sized according to joint size (i.e. small, medium, large). Additionally, the optimal configuration of the skin contacting portion for a particular tool for each joint size may be determined by measuring a number of randomly selected joints and arriving at an "average" joint shape. Such an average shape would allow for deviations among individual joints. It is noted that the contour of a selected soft tissue area may be determined by both the underlying bone structure and the surrounding soft tissue area. In addition, the contour may be affected by other factors such as the particular position of a joint. Therefore, many tools of varying shapes and sizes may be utilized to achieve the desired results.

The shape of the tools may also be modified so that the tools may be used by either left-handed trainers or right-handed trainers. Furthermore, some tools may be configured to include both a bevelled edge and a blade edge so that a single tool may be used for several scar removing functions. An example of such a tool is shown in FIGS. 9A–9D. Similarly, the tools may be configured to include a variety of differently shaped contoured portions so that a single tool may be used for various joints or affected soft tissue areas. In addition, the handle portions of the tools may be modified as needed to allow the trainer more leverage as well as to permit the trainer to reach soft tissue areas which may otherwise be difficult to reach and apply soft tissue therapy thereto.

It will be appreciated that the foregoing is presented by way of illustration only, and not by way of any limitation, and that various alternatives and modifications may be made to the illustrated embodiment without departing from the spirit and scope of the invention.

What is claimed is:

1. A massage tool for use by a trainer to apply pressure to the skin of a patient for the removal of fibrous scar tissue adhesions from underlying soft tissue, comprising:

an elongate rigid body having a first end and a second end, a first flat surface and a second flat surface opposite from said first flat surface, and a peripheral edge extending about the circumference of said body, wherein a first portion of said peripheral edge is configured in the shape of an arc corresponding to the shape of a contour of a selected part of a patient's body from which a scar tissue adhesion is to be loosened from the underlying soft tissue, wherein a second portion of said peripheral edge includes a first tapered surface and a second tapered surface, said first and second tapered surfaces intersecting one another to define a beveled edge.

2. The tool of claim 1, wherein said arc shaped portion of said peripheral edge includes said beveled edge.

3. The tool of claim 1, wherein a third portion of said peripheral edge includes a single tapered surface defining a blade edge.

4. The tool of claim 1, wherein said body is made of aluminum.

5. The tool of claim 1, wherein said arc shaped portion is shaped to correspond to the shape of a knee.

6. A set of massage tools for use by a trainer to apply pressure to the skin of a patient for the removal of fibrous scar tissue adhesion from underlying soft tissue, wherein each tool of said set comprises:

an elongate rigid body having a first end and a second end, a first flat surface and a second flat surface opposite from said first flat surface, and a peripheral edge extending about the circumference of said body, wherein a first portion of said peripheral edge is configured in the shape of an arc corresponding to the shape of a contour of a selected part of a patient's body from which a scar tissue adhesion is to be loosened from the underlying soft tissue, wherein a second portion of said peripheral edge includes a first tapered surface and a second tapered surface, said first and second tapered surfaces intersecting one another to define a beveled edge.

* * * * *